US005749535A

United States Patent [19]

Kahn, III

[11] Patent Number: 5,749,535

[45] Date of Patent: May 12, 1998

[54] DECELERATION DEVICE

[76] Inventor: H. Dante Kahn, III, 4855 Velasquez St., Pensacola, Fla. 32504

[21] Appl. No.: 570,500

[22] Filed: Dec. 11, 1995

[51] Int. Cl.[6] ..... B63B 21/00

[52] U.S. Cl. ..... 242/371; 242/377; 242/417.3; 114/230

[58] Field of Search ..... 242/371, 377, 242/379, 379.1, 390, 395, 416, 417.1, 417.3, 422.2; 114/230

[56] References Cited

U.S. PATENT DOCUMENTS

| | | | |
|---|---|---|---|
| 481,165 | 8/1892 | Darrow | 242/417.3 |
| 577,272 | 2/1897 | Stretch . | |
| 675,453 | 6/1901 | Sturgess | 242/377 |
| 728,823 | 5/1903 | Adams | 242/377 |
| 1,291,029 | 1/1919 | Lamont | 242/379.1 |
| 1,300,606 | 4/1919 | Hayerbuch . | |
| 2,262,587 | 11/1941 | Kaempf | 242/377 |
| 3,084,517 | 4/1963 | Bell . | |
| 3,462,960 | 8/1969 | Bruehl . | |
| 3,464,214 | 9/1969 | King . | |
| 3,564,858 | 2/1971 | Pogonowski . | |
| 4,846,090 | 7/1989 | Palmquist | 242/377 |
| 4,955,309 | 9/1990 | Ciccone | 114/230 |
| 5,178,087 | 1/1993 | O'nion et al. | 114/230 |
| 5,307,753 | 5/1994 | Besonen, Sr. et al. | 114/230 |
| 5,365,872 | 11/1994 | Obrinski | 114/230 |
| 5,524,566 | 6/1996 | Rapa et al. | 114/230 |

FOREIGN PATENT DOCUMENTS

| | | | |
|---|---|---|---|
| 1-284425 | 11/1989 | Japan | 242/417.3 |
| 2-23143 | 1/1990 | Japan | 242/417.3 |
| 214400 | 7/1970 | U.S.S.R. . | |
| 751901 | 7/1980 | U.S.S.R. . | |

*Primary Examiner*—John P. Darling
*Attorney, Agent, or Firm*—Peter Loffler

[57] ABSTRACT

A self-adjusting deceleration device comprises a rewind spool-laden base and pneumatic chamber. A linear medium, attached to the spool, passes into the pneumatic chamber, attaches to a piston, and passes back through the base and out of the device. An energy storage or dampening device is disposed within the pneumatic chamber. The linear medium is attached to the water craft or other item and the spool tenses the linear medium. A water craft shift pulls on the linear medium and causes downward pull on the piston which is gradually decelerated by pneumatic pressure developed within the pneumatic chamber and the energy storage device. A swivel assembly assists in lateral movement of the secured water craft and assists in holding the linear medium outwardly.

14 Claims, 7 Drawing Sheets

FIG. 10A FIG. 10B FIG. 10C
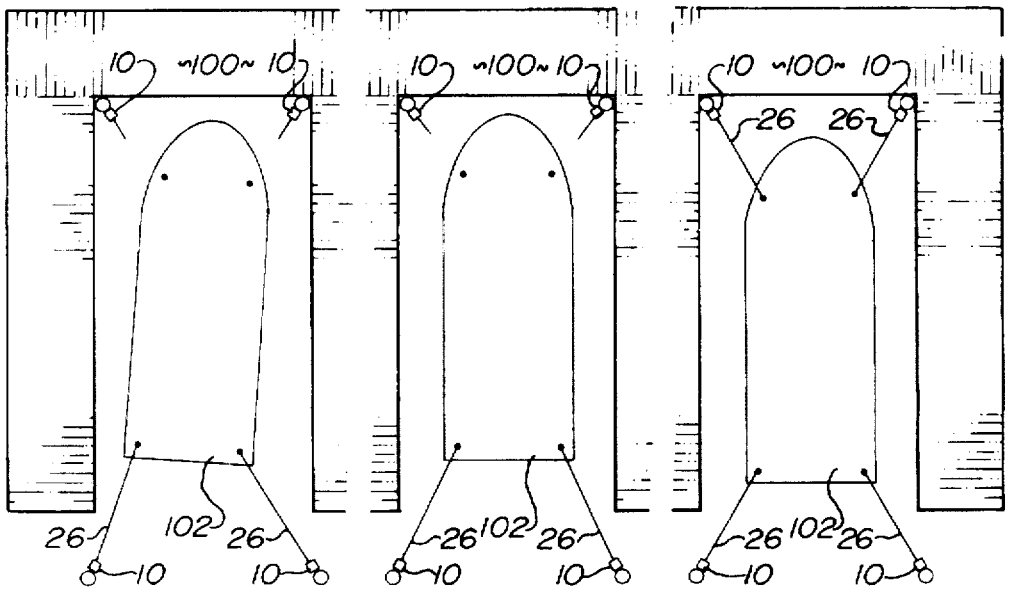
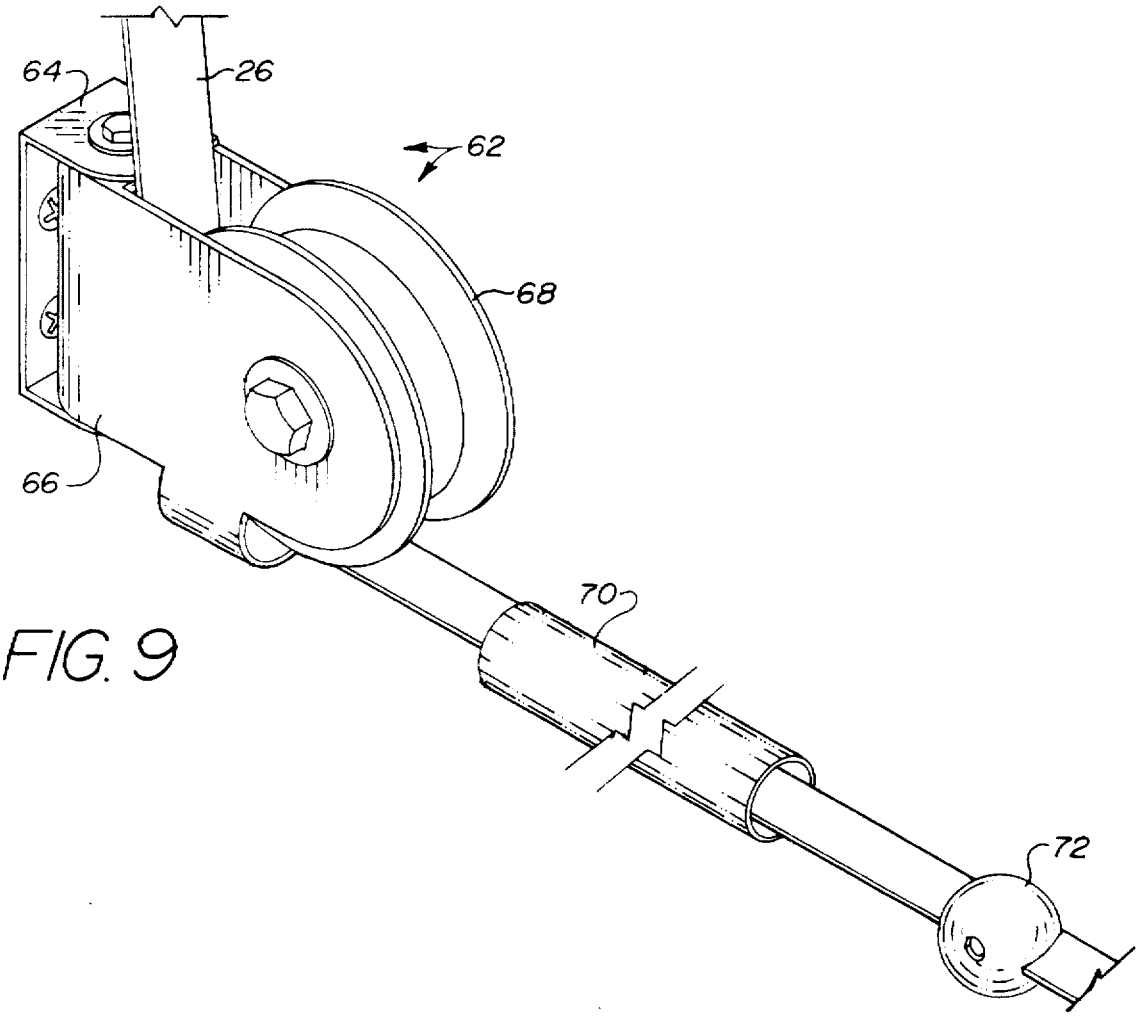
FIG. 9

DECELERATION DEVICE

BACKGROUND OF THE INVENTION

1. Field of the Invention

The present invention relates to a deceleration device and more specifically to a water craft deceleration device having a moving cartridge, located internal within a canister, biased by a spring.

2. Background of the Prior Art

When mooring a boat in a slip, many boaters tend to simply tie the boat down to the dock at one or more points on the boat. Such an approach, although simple and straightforward, suffers substantial drawbacks. If the tie down lines are secured tightly, the boat will undergo severe stress when the tide rises or falls from the original level. As the line will lack play, the rising tide will push the boat higher with the tie down line resisting such raising. Alternately, when the water level falls, the tie down lines prevent the boat from riding downward with the water level. In either case, the boat can suffer damage especially at the tie down points.

If, in order to avoid the above problems, the tie down lines are left with slack, the boat will be free to shift back and forth and side to side. The waves will tend to buffet the boat against the dock. Even with bumper tires mounted, such buffeting can cause extensive damage to the water craft. If sufficient acceleration is achieved, the tie down lines can snap due to shock load. This situation has the potential for catastrophic loss of the craft as well as danger to others.

In order to overcome the shortcomings of simple tie down lines for securing water craft, many securement devices have been proposed. Such devices, as exemplified in U.S. Pat. No. 3,084,517 issued to Bell and U.S. Pat. No. 3,464,214 issued to King, provide dock bumpers that secure or otherwise hold a boat and include acceleration dampening means so that when a boat contacts the device, the boat is gradually slowed so as to minimize damage to the craft.

While some of these devices provide superior results to that of tie down lines only, they are not without their drawbacks. The deceleration is accomplished by device contact with the side of the boat at two or more locations. Such contact, if of sufficient strength or duration, as during a heavy storm, may cause damage to the contact points on the boat. Therefore, such devices lack successful utility.

A device is needed for securing a boat to a dock whereby the boat is prohibited from contacting the dock. The device must adjust for changing tide and weather conditions and must not cause damage to its entrusted water craft. Such a device should be simple to use and construct. Ideally, such a device should be relatively easy to transport.

SUMMARY OF THE INVENTION

The deceleration device of the present invention meets the above-stated needs in the art. The device comprises a deceleration system that relies on a simple linear medium, such as a strap, rope, or other medium, in order to secure a water craft to a dock. However, unlike simple tie down straps, the device permits the boat to shift, both horizontally and vertically, while the linear medium maintains a hold on the water craft at an appropriate level of tension and provides aid in docking maneuvers.

Specifically, the device comprises a base and pneumatic chamber. A spool, having a linear medium thereon, is disposed within the base. A rewind mechanism, either automatic or manual of any appropriate type, rewinds the linear medium onto the spool. The linear medium is passed into the pneumatic chamber, engaging a piston therein, and back out of the pneumatic chamber. The linear medium can be passed multiple times between the bottom of the chamber and the piston by use of appropriate pulleys within the chamber. The piston may be valved or channeled to change dampening action. The piston, initially disposed at the top of the pneumatic chamber, is biased by a coil spring or other energy storage or dampening device such as a shock absorber. The end of the linear medium attaches and holds a water craft. Although use of the device is illustrated with water craft, the deceleration device of the present invention can also be utilized to decelerate, hold, or secure other objects such as a balloon, an aircraft, or any other item that could be secured variably in place.

If the water craft shifts away from the device, the linear medium is despooled in unison with the water craft shift. Upon completion of the despooling, the linear medium pulls downwardly on the piston. The energy storage device coupled with the pneumatic pressure created by the moving piston, gradually decelerate the downward movement of the piston and thereby gradually decelerate the water craft attached thereto. Thereafter, the energy storage device returns the piston back to the top of the pneumatic chamber, the water craft returns to a state of equilibrium, and the excess linear medium is respooled.

This action dampens the movement of the water craft and allows the linear medium to maintain persistent tension. As regular tie down linear medium are utilized, the deceleration of a water craft is accomplished in the preferred manner with the stress of dampening water craft movement placed directly on the appropriate area of a water craft or other secured device, with the invention absorbing the shock load.

If the user desires faster deceleration and less water craft shift, the coil spring can be compressionally preloaded by a preload assembly.

A grasping means for the end of the linear medium, also acting as a chaff guard, a ball connecting point, and a swivel means are also disclosed.

BRIEF DESCRIPTION OF THE DRAWINGS

FIG. 9 is a perspective view of the swivel assembly.

FIG. 10*a*–10*c* illustrate the mooring of a water craft within a slip utilizing the deceleration device of the present invention.

Similar reference numerals refer to similar parts throughout the several views of the drawings.

DETAILED DESCRIPTION OF THE PREFERRED EMBODIMENT

Figure 1:
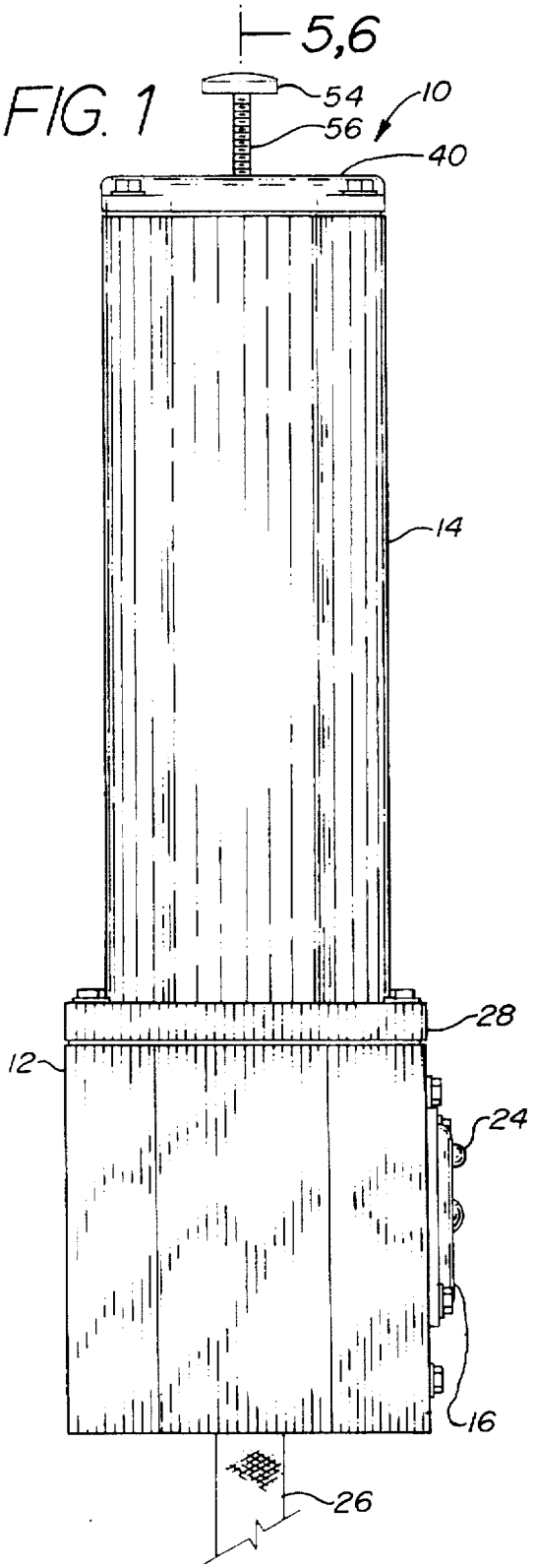
FIG. 1 front elevation view of the deceleration device of the present invention.
Figure 2:
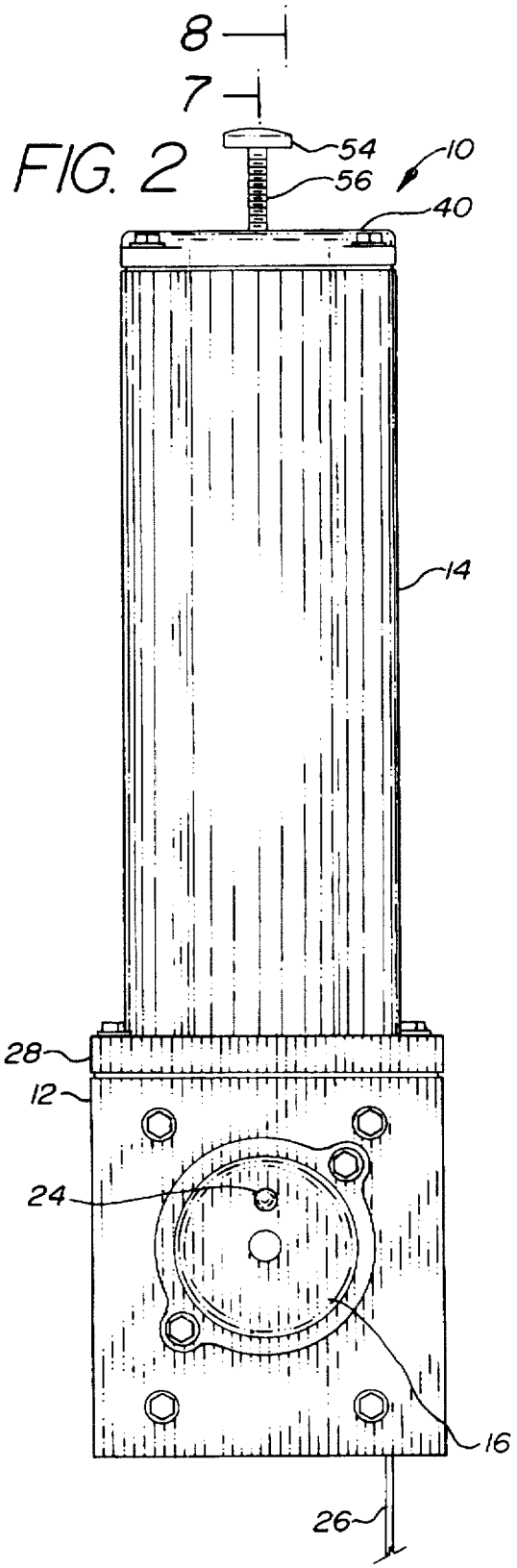
FIG. 2 side elevation view of the deceleration device of the present invention.
Figure 3:
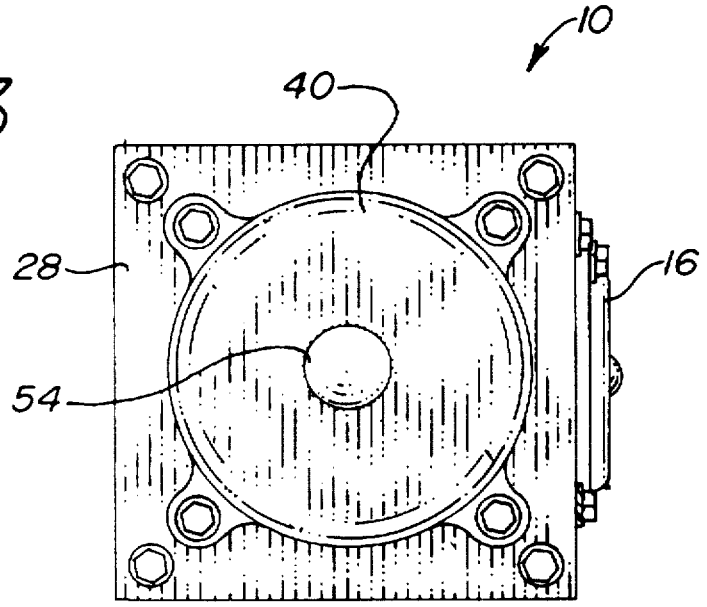
FIG. 3 top plan view of the deceleration device of the present invention.
Figure 4:
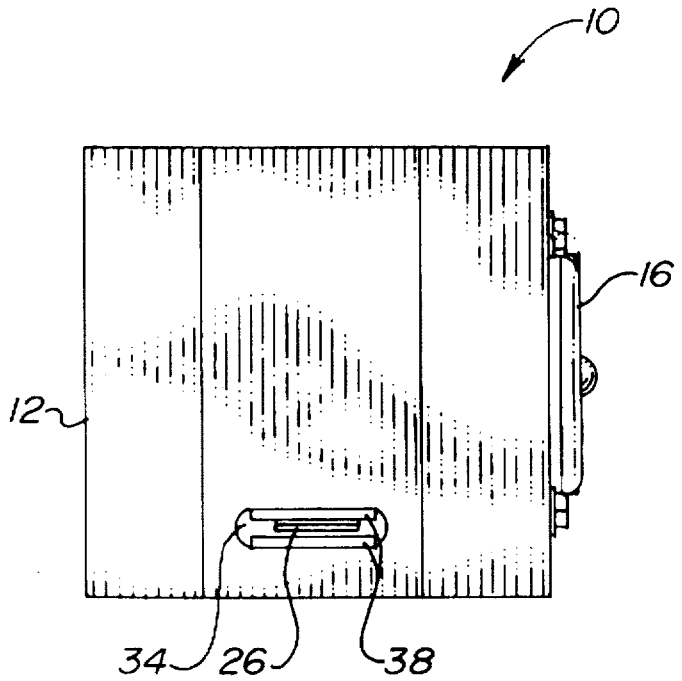
FIG. 4 bottom plan view of the deceleration device of the present invention.
Figure 5:
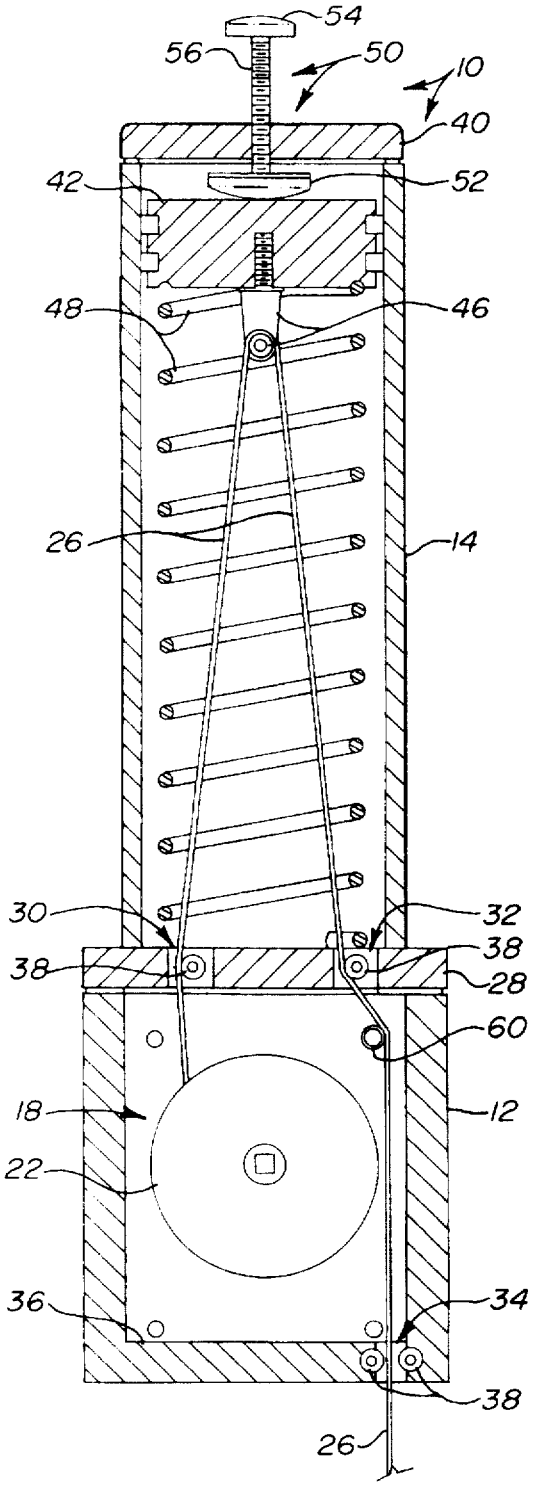
FIG. 5 is a cutaway view of the device in a relaxed state.
Figure 6:
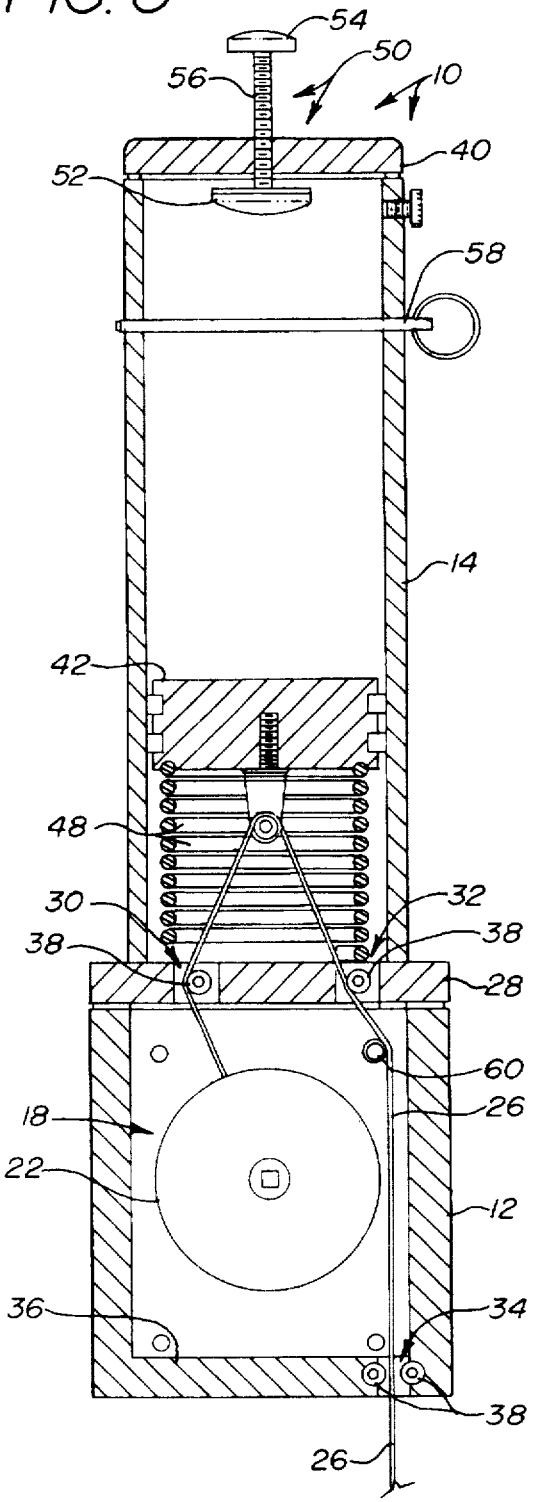
FIG. 6 is a cutaway view of the device in a shifted state.
Figure 7:
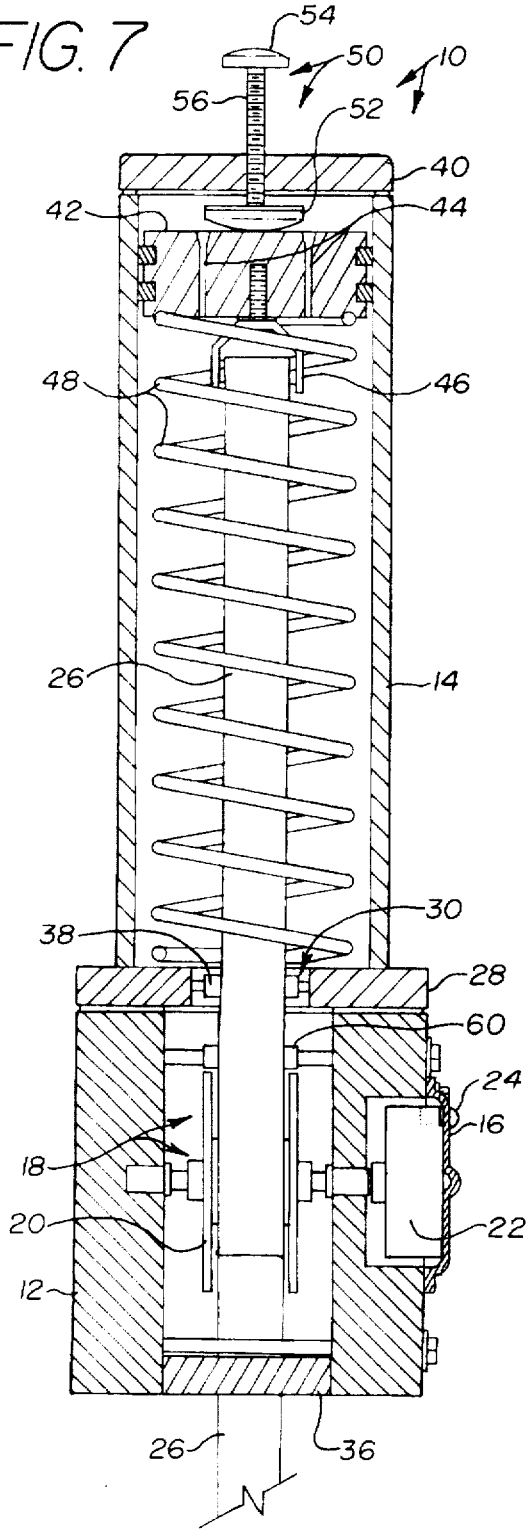
FIG. 7 is a cutaway view of the device taken along line 7—7.
Figure 8:
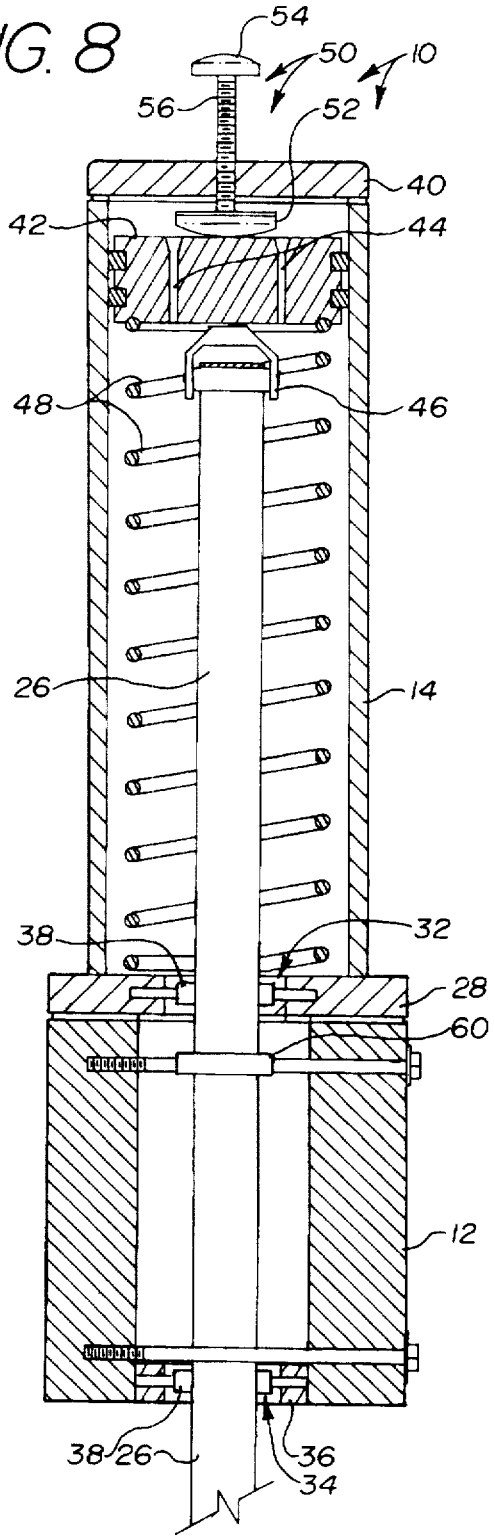
FIG. 8 is a cutaway view of the device taken along line 8—8.

Referring now to the drawings it is seen that the deceleration device, generally referred to by reference numeral 10, comprises a base 12 and a dampening chamber 14.

The base 12 is a generally rectangular-shaped housing member having a hollow interior. As seen, a side plate 16 is boltably and removably secured to the base 12. The removable side plate 16 provides service access to the interior of the base 12. A spooling assembly 18 is disposed within the base 12. The spooling assembly 18 comprises a spool 20, rotatably disposed, and an automatic or manual rewind mechanism 22. If the rewind mechanism 22 is automatic, the rewind mechanism 22 can be either of the spring-loaded type or the motorized type. The rewind mechanism 22, which can have a one-way despool cog 24, as well as a spool lock, on the spool base or rewind mechanism, is boltably and removably secured to the side plate 16 for service access to the rewind mechanism 22. The spool 20 holds a linear medium 26.

Located on the upper plate 28 of the base 12 is a first aperture 30 and a second aperture 32 while a third aperture 34 is located on the lower plate 36 of the base 12. Roller guides 38 are located at the first aperture 30, second aperture 32, and the third aperture 34.

The dampening chamber 14, which is a cylindrical- or other appropriate-shaped pneumatic chamber, is secured to the top of the base 12. A cap 40 is secured to the top of the dampening chamber 14. Slidably disposed within the dampening chamber 14 is a piston 42. One or more pneumatic relief apertures 44 extend, either internally or externally, from the top to the bottom of the piston 42. Alternately, the dampening chamber 14 can be valved in order to provide pneumatic relief. Extending from the bottom of the piston 42 is a roller guide 46. A coil spring 48, or other energy storage device, such as a shock absorber, is disposed within the dampening chamber with one end of the coil spring 48 positioned at the bottom of the dampening chamber 14 while the opposing end of the coil spring is positioned to engage the bottom of the piston 42. A preload assembly 50 is located within the cap 40. The preload assembly 50 comprises a cushioning system such as a bumper 52, disposed within the pneumatic chamber 14, a knob 54, located above the dampening chamber 14 and a rod 56, threadably protruding through the cap, connecting the bumper 52 with the knob 54. Turning the knob 54 in one direction lowers the bumper 52 within the pneumatic chamber 14 thereby preloading the spring 48, while turning the knob 54 in the opposing direction raises the bumper 52 within the pneumatic chamber 14. The preload assembly 50 also slows upward return travel of the piston 42 and adjust overall travel available. Alternately a piston stop bar 58 can be placed at a selected point within the dampening chamber 14 traverse to the path of travel of the piston 42 to achieve the same effect.

In order to utilize the deceleration device of the present invention, the deceleration device 10 is secured to the dock 100, a pole or other sturdy structure that is in close proximity to the water craft 102 or other device to be moored. The linear medium 26 is passed through the first aperture 30 into the dampening chamber 14. The linear medium 26 is passed through the roller guide 46 attached to the bottom of the piston 42 and through the second aperture 32 back into the base 12. The linear medium 26 is then passed through the third aperture 34. A roller guide 60 can be provided within the base 12 in order for the linear medium 26 to clear the spool 20.

The linear medium 26 is ready for attachment to a water craft 102 or other device to be moored. A swivel assembly 62 provides added utility. As seen in FIG. 9, the swivel assembly 62 comprises a mounting bracket 64, a roller bracket 66 swivelly attached to the mounting bracket 64, and a roller 68 rotatably attached to the roller bracket 66. The roller bracket 66 and attached roller 68 are free to axially rotate about the mounting bracket 64. The swivel assembly 60 is mounted, via mounting bracket 64, some distance away from the deceleration device 10 and the linear medium 26 is further passed through the roller 68 before being attached to a water craft 102 or other device to be moored. The swivel assembly 62 permits enhanced lateral movement of the linear medium 26 and permits turning or change of direction of movement of the moored device.

A grip cover 70 encompasses the linear medium 26 and the linear medium 26 passes through a ball 72. The grip cover 70, which is constructed of a rigid or semi-rigid material such as plastic, neoprene or the like, helps keep the end of the linear medium 26 relatively horizontal for easy retrieval by a user and acts as a chaff guard. The ball 72 provides a means to attach the linear medium 26 to a cleat or other similar structure.

The linear medium 26 is attached to a water craft 102 or other device to be secured. Once the linear medium 26 is attached, the deceleration device 10 is in a state where the linear medium 26 is partially or fully despooled and extended. In this state, the rewind mechanism 22, continuously attempts to rewind the linear medium 26 (if of the automatic rewind type) around the spool 20 and provides constant yet gentle tension on the linear medium 26. The coil spring 48 is in a fully extended (relaxed) position. When the water craft 102 shifts away from the deceleration device 10, the linear medium 26 is pulled by the water craft 102 and unwinds from the spool 20. Once the linear medium 26 is despooled, the linear medium 26 pulls downwardly on the roller guide 46 (or multiple guides) attached to the piston 42 and thereby pulls downwardly on the piston 42. The downward traveling piston 42 is biased by the coil spring 48, which, along with pneumatic pressure developed by the traveling piston 42, gradually decelerate the piston 42 and thereby gradually decelerates the linear medium 26 and attached water craft 102. The coil spring 48 gradually returns the piston 42 to the relaxed state. The pneumatic valves 44 assure that any excessive pressure developed within the dampening chamber 14 is bled away and act as a dampener. Once the piston 42 is returned to its relaxed state, the rewind mechanism 22 respools the linear medium 26, and the water craft 102 once again enters equilibrium with the deceleration device 10. The deceleration and reinitiation of the device 10 occur relatively quickly so that the deceleration device 10 is constantly ready. The deceleration device 10 permits gradual deceleration of a shifting of the water craft 102 without undue stress or shock load being placed on the water craft 102 at its points of linear medium 26 attachment, or the linear medium itself.

If desired, the coil spring 48 can be compressionally preloaded by the preload assembly 50. Rotating the knob 54 so that the bumper 52 travels downward, pushes the piston 42 downward causing the coil spring 48 to compress. Such compression preloading of the coil spring 48 is effected when shorter deceleration travel is desired.

Figure 11C:
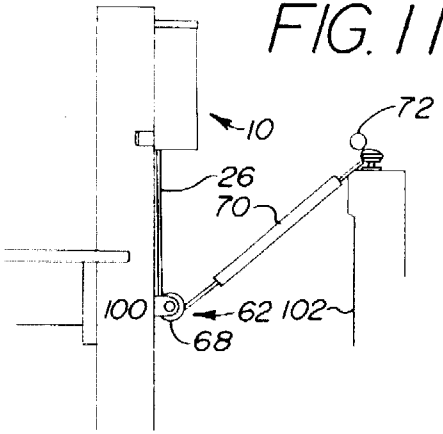
FIG. 11*a*–11*f* illustrate the various movements permitted by the deceleration device of the present invention.
Figure 11F:
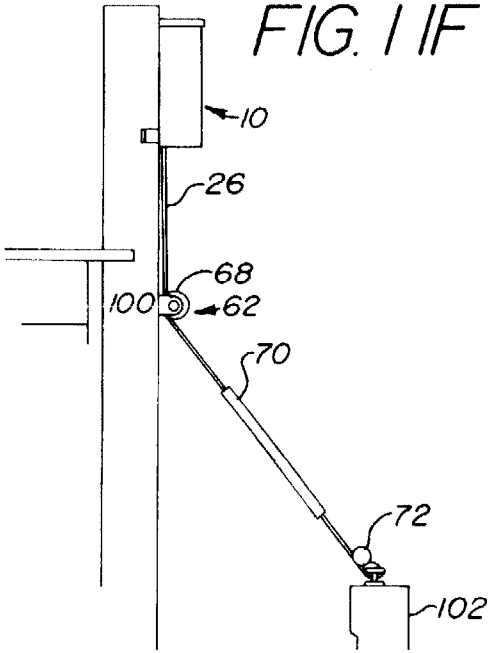
Figure 11B:
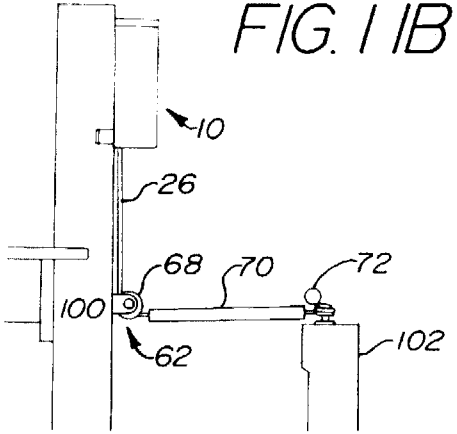
Figure 11E:
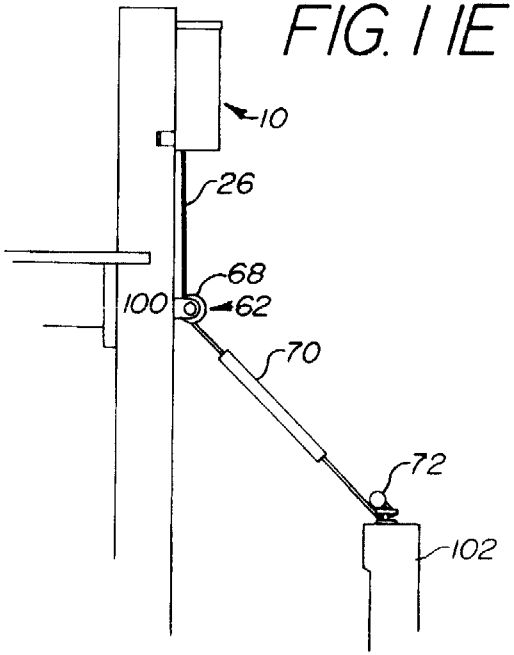
Figure 11A:
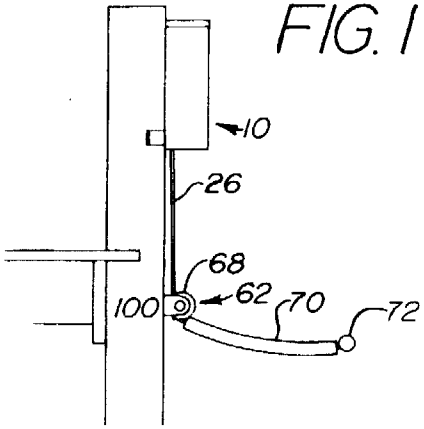
Figure 11D:
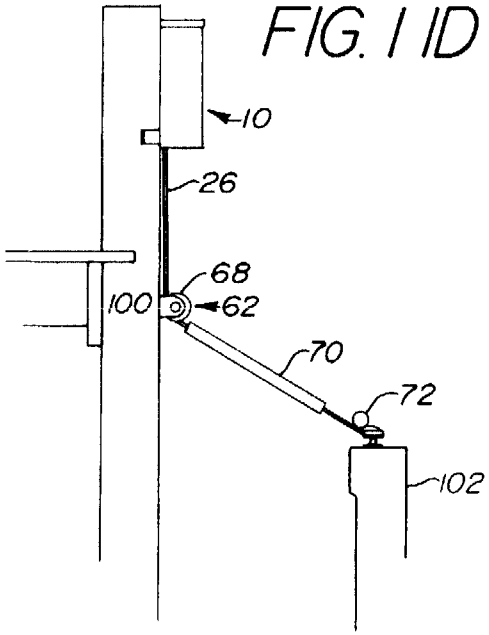
Figure 12:
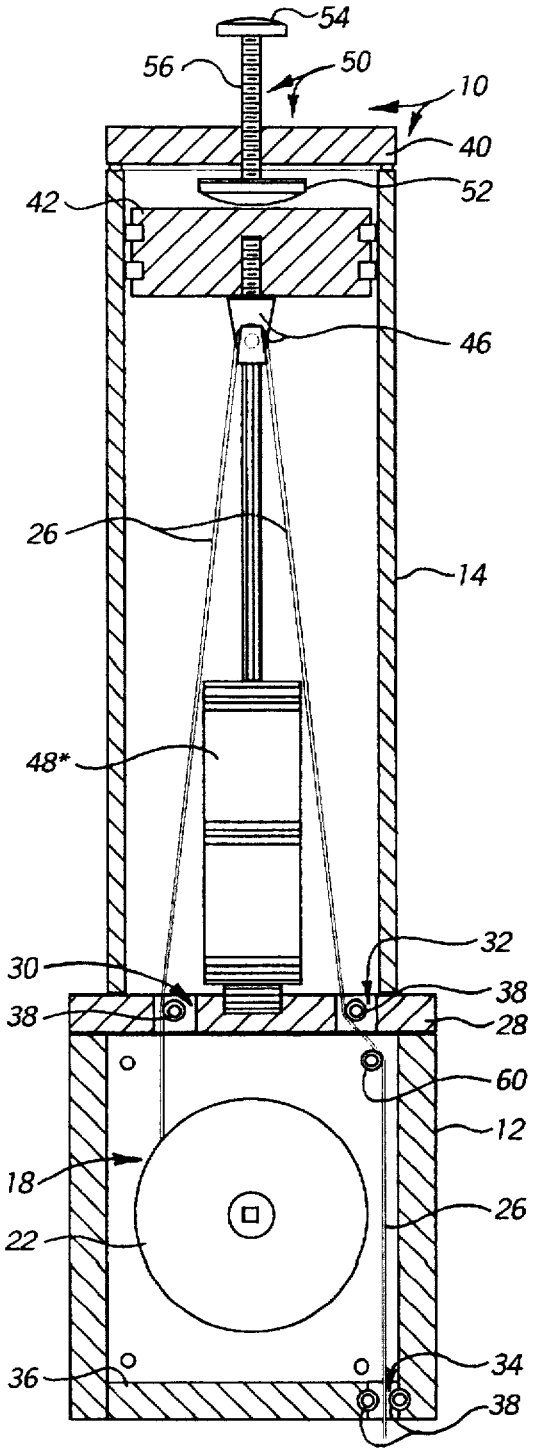
FIG. 12 is a cutaway view of the device illustrating a shock absorber as the energy storage device.
Figure 13:
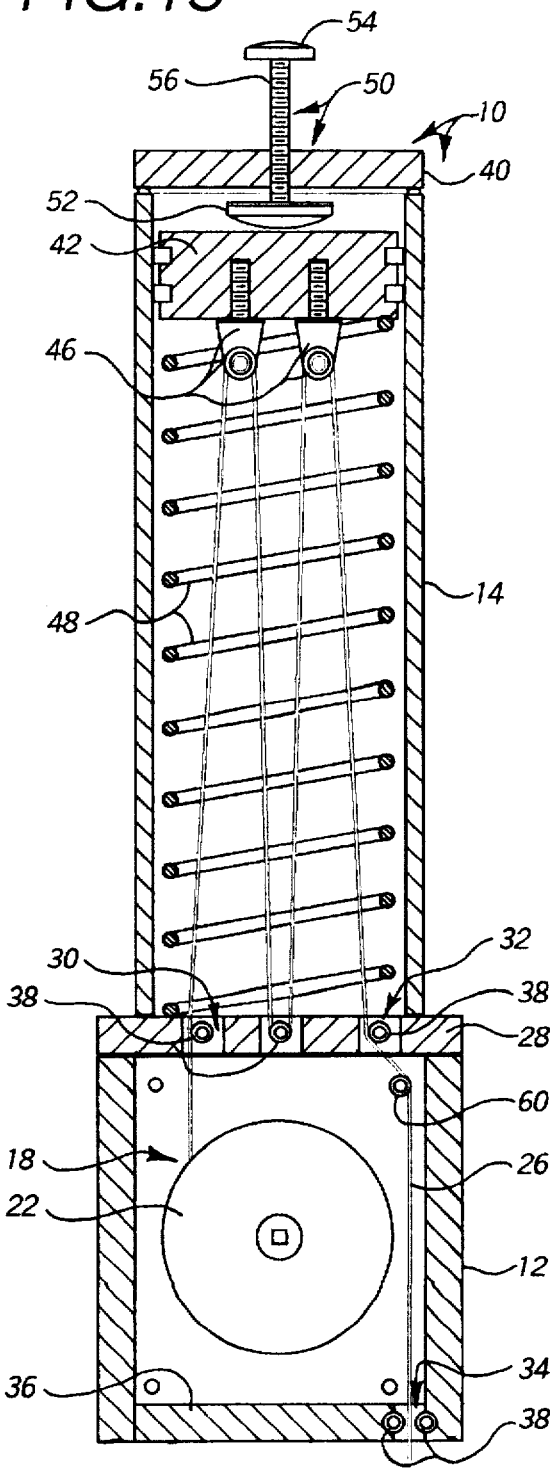
FIG. 13 is a cutaway view of the device illustrating the linear medium making a plurality of revolutions.

As seen in figures 11*a*–11*f*, the device permits multiple shifting of the water craft 102. In FIG. 11*a*, the deceleration device 10 is in a ready state with the cover-encompassed linear medium 26 extending horizontally outward with the ball 72 ready to be grabbed by a user. In FIG. 11*b*, the linear medium 26 is initially attached to a water craft 102. In FIG. 11*c*, the water craft 102 has shifted upward with the linear medium 26 following suit. In FIG. 11*d*, the water craft 102 has shifted downward. In FIG. 11*e*, the water craft 102 has shifted further downward while in FIG. 11*f*, the water craft 102 has shifted even further downward extending the linear medium 26 through is full length of extension. If the water craft 102 shifts sideward the roller bracket swivels in unison to the shifting water craft 102 with the linear medium following suit.

As seen in figures 10*a*–10*c*, a water craft 26 is guided into its slip and a linear medium 26 from a deceleration device 10 is attached to the stern of the water craft 102 thereby decelerating the water craft 102. A second linear medium 26 from a second deceleration device 10 is attached to the stern of the water craft 102 on the opposing side as the side of attachment of the first linear medium 26. This results in straightening as well as further slowing of the water craft 102. Thereafter, the bow of the water craft 102 is secured by the linear mediums 26 from two deceleration devices. The water craft 102 is now securely moored and will not contact the dock 100 or the deceleration devices 10.

While the invention has been particularly shown and described with reference to an embodiment thereof, it will be understood by those skilled in the art that various changes in form and detail may be made without departing from the spirit and scope of the invention.

I claim:

1. A deceleration device comprising:

a base;

a spool located within the base;

a pneumatic chamber attached to the base;

a piston, slidably disposed within pneumatic chamber;

an energy storage means, located within the pneumatic chamber, for biasing movement of the piston;

a linear medium, having a first end attached to the spool and a second end, that passes into the pneumatic chamber and attaches to the piston and then passes out of the device; and a rewind means, for rewinding the linear medium onto the spool.

2. The device as in claim 1 wherein the rewind means comprises an automatic spring-loaded mechanism.

3. The device as in claim 1 wherein the rewind means comprises an automatic motorized mechanism.

4. The device as in claim 1 wherein the rewind means comprises a manual mechanism.

5. The device as in claim 1 wherein the piston is channeled.

6. The device as in claim 1 wherein the pneumatic chamber is valved.

7. The device as in claim 1 to further include an attachment means attached to the second end of the linear medium.

8. The device as in claim 1 wherein the energy storage means comprises a shock absorber.

9. The device as in claim 1 wherein the energy storage means comprises a spring.

10. The device as in claim 9 to further include a preload tension means to compressionally preload the spring.

11. The device as in claim 1 to further include:

a mounting bracket;

a roller bracket, swivelly attached to the mounting bracket;

a roller, rotatably attached to the roller bracket; and wherein the linear medium passes through the roller.

12. The device as in claim 11 to further include an attachment means attached to the second end of the linear medium.

13. The device as in claim 12 to further include a grip cover encompassing the linear medium, located between the roller and a ball.

14. The device as in claim 1 wherein the linear medium makes a plurality of revolutions between the base and the piston.

* * * * *